United States Patent [19]

Taschner

[11] Patent Number: 4,818,502

[45] Date of Patent: Apr. 4, 1989

[54] STERILIZING CONTAINER FOR SURGICAL INSTRUMENTS

[75] Inventor: Wolfgang Taschner, Tuttlingen, Fed. Rep. of Germany

[73] Assignee: Aesculap-Werke AG, Tuttlingen, Fed. Rep. of Germany

[21] Appl. No.: 931,190

[22] Filed: Nov. 14, 1986

[30] Foreign Application Priority Data

Nov. 30, 1985 [DE] Fed. Rep. of Germany ..... 3542404

[51] Int. Cl.[4] ..... E05C 3/04; B65D 45/16

[52] U.S. Cl. ..... 422/310; 422/300; 206/368; 206/508; 220/326; 292/204; 292/209

[58] Field of Search ..... 422/300, 310; 292/204, 292/209; 220/324, 326; 206/363, 368, 508

[56] References Cited

U.S. PATENT DOCUMENTS

| | | | |
|---|---|---|---|
| 1,884,416 | 10/1932 | Wachs et al. | 292/209 |
| 2,402,939 | 7/1946 | Auslander et al. | 292/204 |
| 3,507,531 | 4/1970 | Smith | 292/209 |
| 4,111,476 | 9/1978 | Jacobs | 220/326 |
| 4,512,498 | 4/1985 | Leibinger | 422/310 |
| 4,551,311 | 11/1985 | Lorenz | 422/310 |
| 4,562,047 | 12/1985 | Sestak et al. | 422/310 |

FOREIGN PATENT DOCUMENTS

| | | |
|---|---|---|
| 1321219 | 12/1934 | Fed. Rep. of Germany . |
| 3316141 | 11/1984 | Fed. Rep. of Germany . |

*Primary Examiner*—Barry S. Richman
*Assistant Examiner*—Lynn M. Kummert
*Attorney, Agent, or Firm*—Wolf, Greenfield & Sacks

[57] ABSTRACT

A sterilizer having a bottom part and a lid with a pair of pivotable closure bars mounted on the lid and adapted to be moved between a closed position and an open position. In the closed position, the closure bar coacts with a detent to fix the lid to the bottom part. The free end of the closure bar is angled outwardly for ease of grasping the bar. A stop is provided which defines the open position of the closure bar. When in its open position, the closure bar is generally parallel to the top of the lid and is adapted to be used as a carrying handle for the lid.

9 Claims, 2 Drawing Sheets

Fig.1
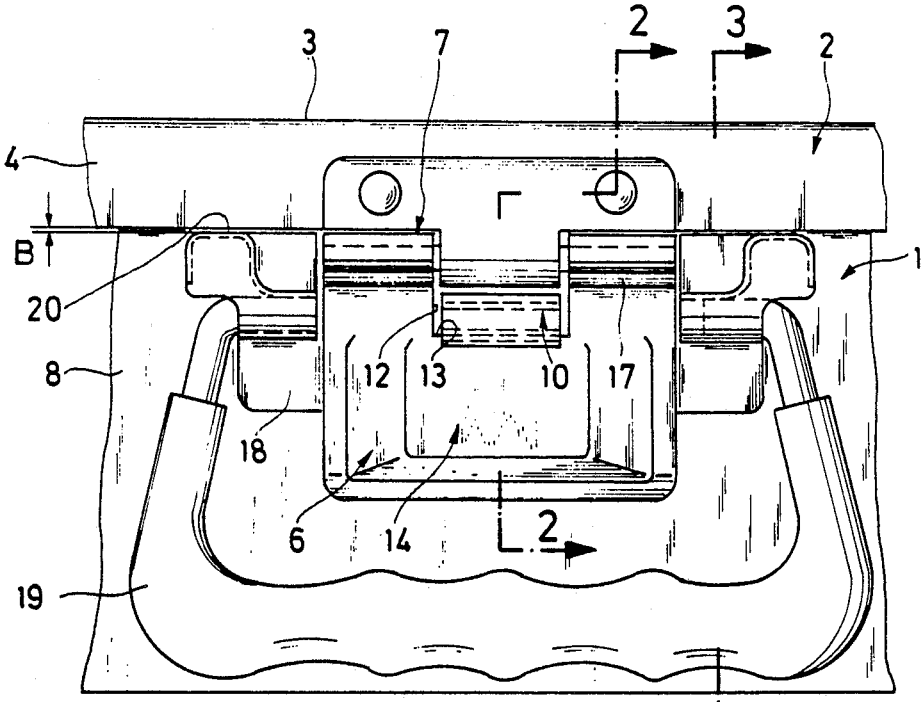
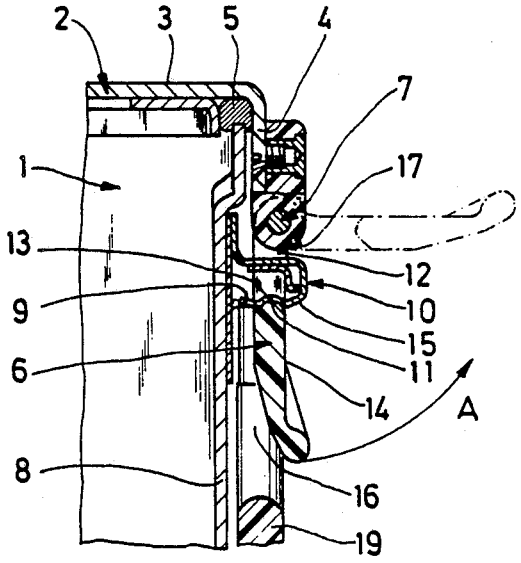
Fig.2
Fig.3
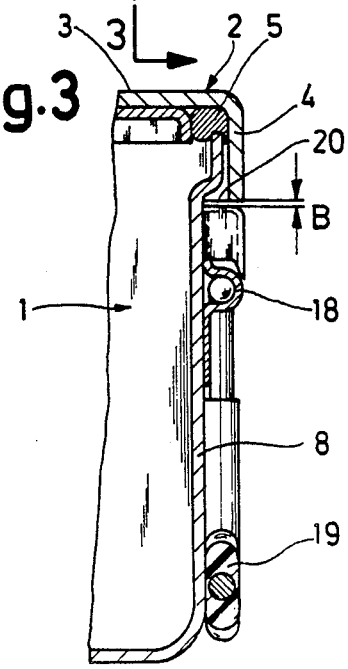

STERILIZING CONTAINER FOR SURGICAL INSTRUMENTS

The invention relates to a sterilizing container for surgical instruments with a tub-shaped bottom part, a lid closing the latter by means of an elastically compressible seal, and a closure means comprising a closure bar which is mounted on the lid, is pivotable between a closed position and an open position, and is fixed in the closed position.

Such sterilizing containers are known, for example, from German Utility Model No. 1,321,219 or from German Offenlegungsschrift (unexamined Patent Application) No. 3,316,141.

When removing the lid from the container, in the known sterilizing containers, reaching into the gap between lid and container to release the lid from the container often proves arduous. Gripping at the closure bars is rendered difficult by their freely pivotable mounting on the lids and by they themselves, in accordance with their function as closure bars, being unwieldy.

The object of the invention is to create a generic sterilizing container design which facilitates handling of the lids.

This object is attained in accordance with the invention in a sterilizing container of the kind described at the outset by the closure bar resting in its open position against a stop defining an end position of the closure bar in which the closure bar is arranged substantially parallel to the upper side of the lid. In this end position, the closure bars therefore protrude substantially laterally from the lid and thus act as handles by which the lid may be lifted off the bottom part or placed on the bottom part. This enables substantially improved handling of the lid, particularly if the closure bar itself is designed as a carrying handle, i.e., its dimensions and shape are convenient to handle.

It is particularly advantageous for the closure bar to consist of a sterilizable plastic since this is extremely pleasant to grip.

In a preferred embodiment, provision is made for the closure bar to slant outwardly at its free end, which produces a gap between the side wall of the container and the free end of the closure bar for insertion of the fingers to open the closure bar.

It is particularly advantageous for the closure bar to be fixed in the closed position by means of an elastic detent member. This is preferably attached to the side wall of the container.

In a preferred embodiment, the detent member protrudes through an opening in the closure bar when the latter is in the closed position.

The detent member may be a leaf spring with a bent-in portion in which the closure bar engages in the closed position. In another preferred embodiment, the detent member is a rigid peg with a recess in which the closure bar engages in the closed position, and the elasticity of the detent fixing is attained by the elastically deformable seal between bottom part and lid and/or an elastic deformability of the side wall of the container. In all cases, it is advantageous for the detent member to comprise an inclined guide along which the closure bar slides when pivoted into the closed position, thereby clamping the lid against the bottom part. After the lid has been set on, it is therefore possible to clamp it against the bottom part by pivoting the two closure bars into the closed position.

Provision of a stop for the lid which delimits approach of the lid to the bottom part is particularly expedient. Damage to the elastic seal is thereby avoided, for example, when quite a large number of containers are stacked one on top of the other, in which case a heavy load is placed on the bottom containers.

It is advantageous for the stop to be so positioned that the closure bar is only pivotable from the closed position to the open position under elastic deformation of the detent member. Thus the elasticity of the elastic seal alone ensures that the lid cannot be pressed so far against the tub that the detent connection between the closure bar and the detent member is released. In the case of maximum approach of the lid to the bottom part, opening of the closure bar is also only possible by overcoming the elastic closing force of the detent member.

In a preferred embodiment, elastic detent members or friction brakes are provided to releasably fix the closure bar in different angular positions. For example, after being pivoted out into the end position, the closure bars therefore remain therein so that also after removal, the lid can be gripped any time in a simple manner at the closure bars protruding like handles.

In a further preferred embodiment, provision is made for the closure bar to be inwardly pivotable approximately parallel to the underside of the lid after removal of the lid. The closure bar remains in this inwardly set position particularly if an elastic detent member and a friction brake are used, so that when quite a large number of lids lean against one another vertically, as is the case, for example, in a dishwasher, the metallic lids are not immediately contiguous but are separated from one another by the closure bars which preferably consist of plastic. In this inwardly pivoted position, the closure bars act as spacers between adjacent lids.

The following description of preferred embodiments serves in conjunction with the drawings to explain the invention in greater detail.

FIG. 1 is a partial side view of a sterilizing container in the closure area;

FIG. 2 is a sectional view taken on line 2—2 in FIG. 1;

FIG. 3 is a sectional view taken on line 3—3 in FIG. 1;

Figure 4:
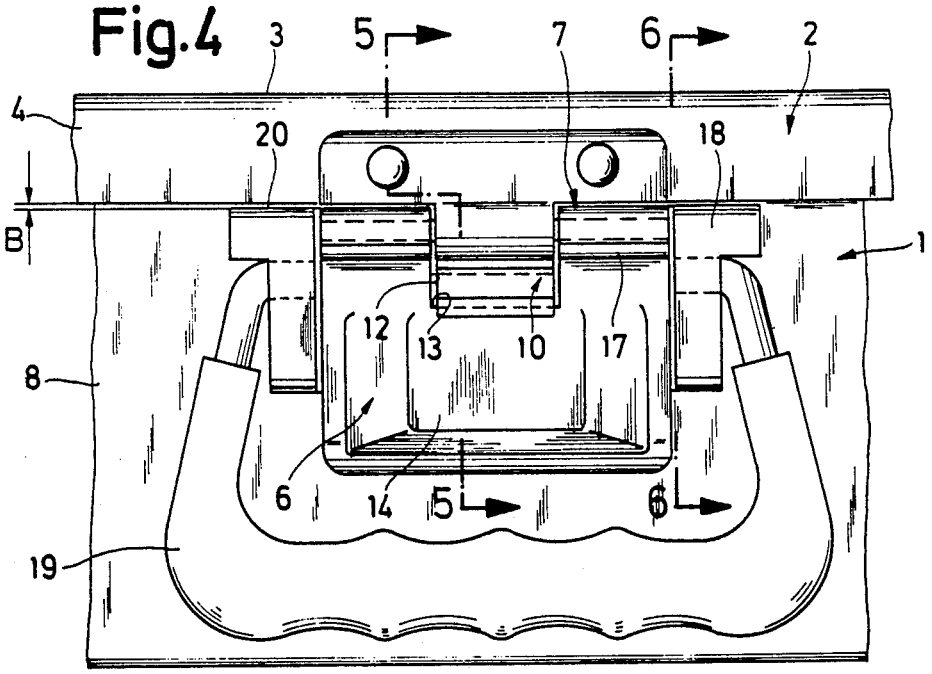
FIG. 4 is a view similar to FIG. 1 of a modified embodiment of a sterilizing container.

The sterilizing container illustrated in FIGS. 1 to 3 comprises a tub-shaped bottom part 1 with a lid 2 set on it. Adjoining the upper side 3 of the lid are vertically downwardly extending edge flanges 4. The lid 2 is set on the bottom part 1 in the closed state and then rests on the upper edge of the bottom part 1 by means of an elastically deformable annular seal 5 extending around it, with the edge flanges 4 overlapping the upper edge of the bottom part 1 (FIGS. 2 and 3).

At opposite edge flanges, the lid carries one closure bar 6, in each case, which is pivotable at a hinge 7 attached to the edge flange 4 about an axis extending parallel to the bottom edge of the edge flange 4. The closure bar 6 is in the form of a broad carrying handle made of sterilizable plastic which is of substantially U-shaped configuration and is convenient to grip. The hinge mounting is at the free ends of the two U-legs.

Attached to the adjacent side wall 8 is a leaf spring 9 which is bent in the form of an outwardly projecting detent nose 10 and exhibits an indentation 11 on its underside in the proximity of the free end of the leaf spring 9. When the closure bar 6 is in the closed state, the detent nose 10 protrudes so far through the opening 12 between the two legs of the U-shaped closure bar 6 that the upper edge 13 of the transversely extending leg 14 of the U-shaped closure bar 6 engages the indentation 11 (FIG. 2). The closure bar is thereby held in the closed position. The area of the leaf spring 9 immediately adjoining the indentation 11 towards the outer side is in the form of a guide 15 which extends upwardly at an incline so that when the closure bar 6 is being closed, the closure bar and with it the lid are pulled downwardly so that the lid is clamped against the bottom part.

The closure bar 6 is pivotable from the closed position illustrated in FIG. 2 in the direction of arrow A into an open position. This is facilitated by the closure bar 6 extending outwardly at an incline at its lower end so as to produce an upwardly tapering insertion slit 16 into which an attendant can reach with his fingers to thereby grip the closure bar 6 on the inner side.

When the closure bar is pivoted into the open position, it is maximally pivotable to an end position in which it projects substantially horizontally from the container (dot-and-dash position in FIG. 2). This is attained by a stop 17 formed on the closure bar 6 in the area of its hinged mounting which strikes the hinge 7 when the closure bar is pivoted into the open position. When the closure bar protrudes outwardly in the illustrated manner, it can be used as carrying handle for the lid so that it is particularly easy to remove it from the container and replace it on it.

Provision may be made for the pivotal motion of the closure bar 6 to be impeded by a friction brake so that the closure bar remains in each set angular position without falling under the influence of its own weight into the vertical position. This is attainable, for example, by suitable spring means or suitable dimensionings of the hinge. It is also possible to provide elastic detent means to fix the closure bar 6 in different angular positions, for example, spring-loaded balls in the hinge which engage bores in the circumference of the hinge part of the closure bar 6. In this way, the carrying-handle-type closure bars 6 can be made to remain in the outwardly bent position so that a lid which has been removed is easier to grip.

The closure bars 6 are mounted underneath the bottom edge of the edge flange 4 so that the closure bars 6 can be folded inwardly, also after removal of the lid, until they strike the inner side of the lid. In this position, they form spacers between adjacent lids which are placed on edge alongside one another, for example, in a dishwasher. Metallic contact between adjacent lids is thereby avoided.

Attached to the side wall 8, on either side of the area of the side wall of the bottom part 1 covered by the closure bar 6, are fittings 18 in which a carrying handle 19 surrounding the closure bar 6 is pivotably held. The bottom part 1, more particularly, both the unclosed bottom part and the bottom part closed by a lid, can be lifted by this carrying handle 19.

On the upper side, the fittings 18 form stops 20 which are so arranged opposite to the bottom edge of the edge flanges 4 of the lid 2 that the edge flanges 4 of the lid 2 come to rest against these stops 20 when they are pressed downwardly. This avoids excessive elastic deformation of the annular seal 5 which might otherwise be damaged. The position of the stops 20 is so selected that when the edge flange 4 rests against the stop 20, the upper edge 13 of the horizontal leg 14 of the closure bar 6 still sinks into the indentation 11 in the detent nose 10, i.e., when the lid 2 is lowered to the maximum extent, the detent nose 10 still ensures secure fixing of the closure bar 6. In this maximally lowered position of the lid, opening is therefore also only possible by elastic deformation of the detent nose 10.

Normally, the lower edge of the edge flange does not rest on the stops 20 as long as the lid is not subjected to heavy load and as long as the annular seal 5 has its normal elasticity at its disposal. In these cases, there is usually a small space B between the lower edge of the edge flange 4 and the stop 20 (FIG. 3).

Figure 5:
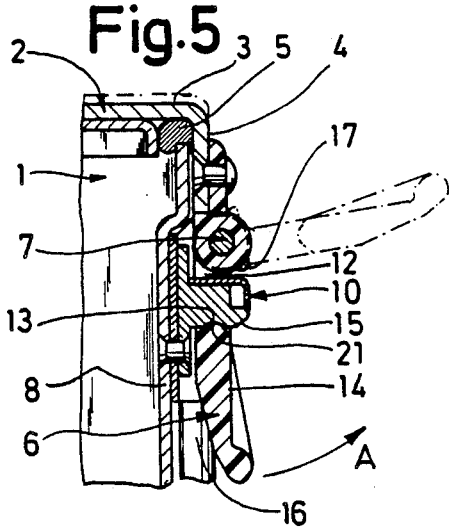
FIG. 5 is a sectional view taken on line 5—5 in FIG. 4.
Figure 6:
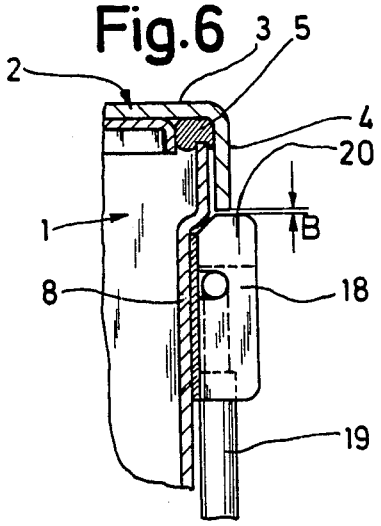
FIG. 6 is a sectional view taken on line 6—6 in FIG. 4.

The embodiment illustrated in FIGS. 4 to 6 is substantially identical to that shown in FIGS. 1 to 3 and corresponding parts, therefore, bear the same reference numerals.

The essential distinguishing feature of this embodiment is the design of the detent nose 10. In the embodiment shown in FIG. 5, it is a solid component which is not elastically deformable in itself. The detent nose 10 in the embodiment shown in FIGS. 4 to 6 does, however, acquire a certain elasticity through attachment to the side wall 8 of the bottom part 1. This side wall is elastically deformable to a slight extent so that slight elastic pivoting of the detent nose 10 is also possible since this detent nose engages the side wall 8 of the bottom part 1 with a relatively large lever arm once the locking bar 6, having passed the guide surface 15, engages an indentation 21 on the underside. The indentation 21 coressponds to the indentation 11 of the detent nose 10 comprised of a leaf spring in the embodiment shown in FIGS. 1 to 3.

What is claimed is:

1. A sterilizing container comprising:

a tub shaped bottom part having an upper edge at its open top, a rigid lid adapted to fit on said upper edge and to close said bottom part, an elastically compressible seal disposed between said bottom part upper edge and said lid, a pair of closure bars mounted on the lid, each of said closure bars extending from a pivotally mounted end to a free end, means mounted on said lid for pivoting of each of said closure bars between a closed position and an open position, means mounted on said bottom part for coacting with each of said closure bars when in the closed position to fix the lid to the bottom part, each coacting means including (i) an elastic detent member having an inclined guide along which each corresponding closure bar slides when pivoted into the closed position to clamp the lid against the bottom part and (ii) a lid stop which delimits the approach of the lid to the bottom part, and a closure bar stop disposed between each pivoting means and each corresponding closure bar to define an end position for each closure bar when the closure bar is in the open position, each closure bar, when in the end position, resting against each corresponding stop and extending perpendicularly from the lid, being positioned and arranged for use as a carrying handle for the lid.

2. A sterilizing container as defined in claim 1 wherein each closure bar is formed of a plastic suitable for withstanding sterilization temperatures.

3. A sterilizing container as defined in claim 1, wherein each closure bar is outwardly inclined at the free end whereby an insertion gap for fingers to open each closure bar is provided between a side wall of the bottom part and the free end of each closure bar.

4. A sterilizing container as defined in claim 1, wherein said lid stop is positioned and arranged so that each closure bar is only pivotable from the closed position to the open position under elastic deformation of each corresponding detent member.

5. A sterilizing container as defined in claim 1, wherein each closure bar is positioned and arranged to be inwardly pivotable to be approximately parallel to an underside of the lid when the lid has been removed from the bottom part.

6. A sterilizing container as defined in claim 1, wherein each detent member is attached to a side wall of the bottom part.

7. A sterilizing container as defined in claim 6, including an opening in each closure bar through which each corresponding detent member protrudes when the closure bar is in the closed position.

8. A sterilizing container as defined in claim 7, wherein each detent member is a leaf spring with a bent-in portion in which each corresponding closure bar is engaged when in the closed position.

9. A sterilizing container as defined in claim 7, wherein each detent member includes a rigid component with a recess in which each corresponding closure bar is engaged in the closed position and wherein each detent member mounts each corresonding rigid component on a side wall of said bottom part that is elastically deformable.

* * * * *